US008518500B2

(12) United States Patent
Yasumatsu

(10) Patent No.: US 8,518,500 B2
(45) Date of Patent: Aug. 27, 2013

(54) THERMAL TRANSFER SHEET AND INK RIBBON

(75) Inventor: Ryo Yasumatsu, Kanagawa (JP)

(73) Assignee: Sony Corporation, Tokyo (JP)

( * ) Notice: Subject to any disclaimer, the term of this patent is extended or adjusted under 35 U.S.C. 154(b) by 205 days.

(21) Appl. No.: 12/775,818

(22) Filed: May 7, 2010

(65) Prior Publication Data

US 2010/0304056 A1 Dec. 2, 2010

(30) Foreign Application Priority Data

May 29, 2009 (JP) ..... 2009-129785

(51) Int. Cl.

| | |
|---|---|
| ***B41M 5/40*** | (2006.01) |
| ***B41M 5/42*** | (2006.01) |
| ***B41M 5/44*** | (2006.01) |
| ***B41M 5/385*** | (2006.01) |
| ***B41M 5/382*** | (2006.01) |

(52) U.S. Cl.

CPC . *B41M 5/42* (2013.01); *B41M 5/44* (2013.01); *B41M 5/385* (2013.01); *B41M 5/423* (2013.01); *B41M 5/38214* (2013.01)

USPC ..... 428/32.69; 428/32.77; 428/32.79

(58) Field of Classification Search

CPC ..... B41M 5/42; B41M 5/44; B41M 5/385; B41M 5/423; B41M 5/38214

USPC ..... 428/32.69, 32.77, 32.79

See application file for complete search history.

(56) References Cited

U.S. PATENT DOCUMENTS

| | | | | |
|---|---|---|---|---|
| 5,045,383 | A | 9/1991 | Maeda et al. | |
| 7,402,365 | B1 | 7/2008 | Bailey et al. | |
| 2001/0036561 | A1* | 11/2001 | Wolk et al. | 428/690 |
| 2002/0076552 | A1* | 6/2002 | Hsu | 428/355 AC |
| 2003/0157356 | A1* | 8/2003 | Tamura et al. | 428/542.2 |
| 2006/0068174 | A1 | 3/2006 | Sato | |
| 2007/0031616 | A1* | 2/2007 | Sogabe et al. | 428/32.51 |

FOREIGN PATENT DOCUMENTS

| | | |
|---|---|---|
| FR | 2755059 A1 | 10/1997 |
| JP | 2006-012486 | 1/2006 |
| JP | 2006-124686 | 5/2006 |
| JP | 2009-073150 | 4/2009 |

OTHER PUBLICATIONS

European Patent Office, Office Action issued in Patent Application EP 10004654.9, on Sep. 14, 2010.

Japanese Office Action dated Mar. 19, 2013 for related Japanese Application No. 2009-129785.

* cited by examiner

*Primary Examiner* — Betelhem Shewareged

(74) *Attorney, Agent, or Firm* — Dentons US LLP

(57) ABSTRACT

A thermal transfer sheet includes a sheet substrate; a protective layer provided on the sheet substrate; and an adhesive layer provided on the protective layer, wherein a refractive-index difference between the protective layer and the adhesive layer is less than 0.10.

9 Claims, 4 Drawing Sheets

MEASUREMENT LENGTH OF SURFACE ROUGHNESS
(EXAMPLE 6)

MEASUREMENT LENGTH OF SURFACE ROUGHNESS
(COMPARATIVE EXAMPLE 4)

THERMAL TRANSFER SHEET AND INK RIBBON

BACKGROUND OF THE INVENTION

1. Field of the Invention

The present invention relates to a thermal transfer sheet and an ink ribbon, in particular, to a thermal transfer sheet that has excellent capability of peeling at the interface between a non-transferable peeling layer and a protective layer and can impart high glossiness to printed matter.

2. Description of the Related Art

A protective layer composed of a thermoplastic resin is laminated on an image formed on a printing paper sheet, for example, an ink image formed by a sublimation thermal-transfer method using a sublimation or thermal diffusion dye. When such a protective layer is made to have a gas barrier property or an ultraviolet absorbing property, discoloration of an image covered with the protective layer can be suppressed and migration of ink forming the image to other articles containing plasticizers such as erasers can be suppressed.

A protective layer can be laminated on an ink image, for example, with a thermal transfer sheet. Such a thermal transfer sheet has a configuration in which a non-transferable peeling layer, a protective layer, and an adhesive layer are stacked on a sheet substrate in this order from the sheet substrate side of the thermal transfer sheet. By partially heating and pressing the sheet substrate side of the thermal transfer sheet, the protective layer corresponding to the heated part is transferred together with the adhesive layer as a protective laminate onto a printing paper sheet.

A thermal transfer sheet having a configuration in which a protective layer composed of a first resin and an adhesive layer composed of a second resin are stacked and 1.5 is the boundary value between the refractive index of the first resin and the refractive index of the second resin has been proposed (Japanese Unexamined Patent Application Publication No. 2006-12486). This is intended to suppress generation of rainbow unevenness (interference pattern) caused by the small thickness of a protective laminate that is to be transferred onto a printing paper sheet and is constituted by the protective layer and the adhesive layer.

SUMMARY OF THE INVENTION

However, when a thermal transfer sheet having such a configuration has a large refractive-index difference between a protective layer and an adhesive layer, scattering of light is caused at the interface between the protective layer and the adhesive layer. Such scattering of light can cause degradation of the glossiness of an ink image onto which a protective laminate has been transferred so as to cover the ink image.

Accordingly, it is desirable to provide a thermal transfer sheet and an ink ribbon configured to suppress scattering of light at the surface of a protective layer and at the interface between the protective layer and an adhesive layer transferred to printed matter on which an ink image has been formed to thereby achieve image quality excellent in terms of glossiness.

A thermal transfer sheet according to an embodiment of the present invention includes a sheet substrate; a protective layer provided on the sheet substrate; and an adhesive layer provided on the protective layer wherein a refractive-index difference between the protective layer and the adhesive layer is less than 0.10.

An ink ribbon according to an embodiment of the present invention includes a sheet substrate; a protective region including a protective layer and an adhesive layer sequentially stacked on the sheet substrate in this order; and a printing region including an ink layer; wherein the protective region and the printing region are provided in a planar arrangement, and a refractive-index difference between the protective layer and the adhesive layer is less than 0.10.

In a thermal transfer sheet and an ink ribbon that have such a configuration, reflection of light is suppressed at the interface between the protective layer and the adhesive layer in which a refractive-index difference between the protective layer and the adhesive layer is less than 0.10. Accordingly, scattering of light at the interface between the protective layer and the adhesive layer can be suppressed irrespective of the state of the interface between the protective layer and the adhesive layer.

As has been described, according to embodiments of the present invention, scattering of light can be suppressed at the interface between the protective layer and the adhesive layer. Thus, by transferring the protective layer onto printed matter on which an ink image has been formed, image quality having excellent glossiness can be provided.

DESCRIPTION OF THE PREFERRED EMBODIMENTS

Hereinafter, embodiments according to the present invention will be described in the following order with reference to the drawings.

1. First embodiment: an example of a thermal transfer sheet including a protective layer
2. Second embodiment: an example of an ink ribbon including a protective layer and an ink region

1. First Embodiment

Figure 1:
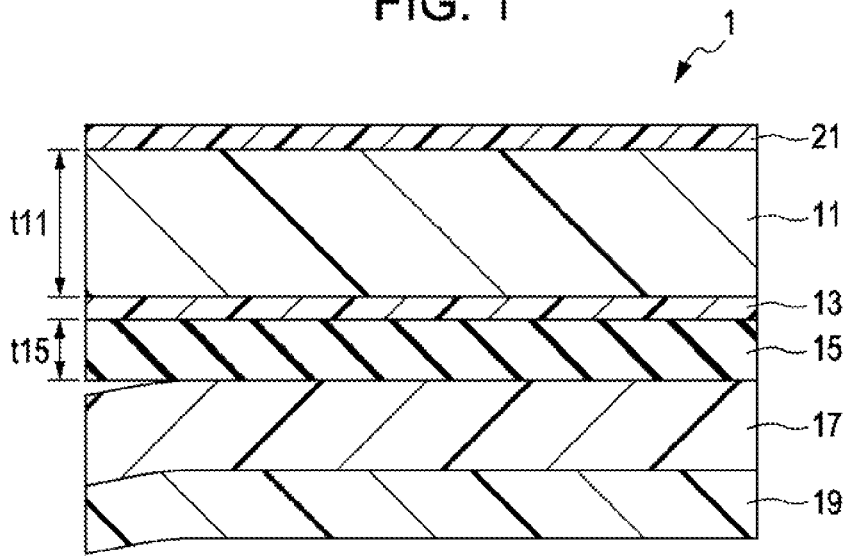
FIG. 1 is a sectional schematic view of a main part of a thermal transfer sheet according to an embodiment of the present invention.

FIG. 1 is a sectional schematic view of a main part illustrating the configuration of a thermal transfer sheet 1 according to an embodiment of the present invention. The thermal transfer sheet 1 of this embodiment illustrated in FIG. 1 is used to cover (as a laminated layer) and protect an ink image having been formed in printed matter and has the following configuration.

Specifically, the thermal transfer sheet 1 has a configuration in which a primer layer 13, a non-transferable peeling layer 15, a protective layer 17, and an adhesive layer 19 are stacked in this order on a main surface of a sheet substrate 11 and a heat-resistant slip layer 21 is provided on the other main surface of the sheet substrate 11. In the thermal transfer sheet 1 having such a layer configuration, a first feature is that the refractive-index difference between the protective layer 17 and the adhesive layer 19 is made less than 0.10; and a second feature is that the configuration of the non-transferable peeling layer 15 is defined. Hereinafter, the detailed configurations of the layers of the thermal transfer sheet 1 will be described starting from the configuration of the sheet substrate 11.

Sheet Substrate 11

The sheet substrate 11 supports various coating-film layers stacked thereon and is subject to thermal energy given by a thermal transfer head. Thus, the sheet substrate 11 is desirably composed of a material having heat resistance, mechanical strength, and dimensional stability and is desirably selected in consideration of stability of material supply, cost, and the like. As for the sheet substrate 11, substrates used for ordinary thermal transfer sheets and ink ribbons may be used without being treated and, alternatively, other substrates may also be used. Preferred specific examples of the sheet substrate 11 include general-purpose plastic films such as polyester films, polyethylene films, and polypropylene films; and super engineering plastic films such as polyimide films.

In particular, since super glossiness of printed matter is desirably provided after the lamination of the protective layer 17 on the printed matter by thermal transfer, a material having a high surface smoothness is preferably selected as the sheet substrate 11.

Primer Layer 13

The primer layer 13 is provided for enhancing the adhesion between the sheet substrate 11 and the non-transferable peeling layer 15. The primer layer 13 may be formed of a urethane resin, an acrylic resin, a polyester resin, or the like.

Alternatively, instead of the primer layer 13, a simple adhesive layer composed of an acrylic resin, a polyester resin, or the like may be provided. The simple adhesive layer is preferably provided on the sheet substrate 11 so as to have a uniform thickness. Such a simple adhesive layer can be formed by forming a simple adhesive layer having a thickness of several micrometers on the sheet substrate 11 and subsequently subjecting the sheet substrate 11 to a biaxial stretching treatment, so that the simple adhesive layer is also stretched into a thin film having a uniform thickness of 1 μm or less.

When the adhesion between the sheet substrate 11 and the non-transferable peeling layer 15 is high, the primer layer 13 may be eliminated.

Non-Transferable Peeling Layer 15

The non-transferable peeling layer 15 of a preferred example has rubber-like elasticity. In this case, the non-transferable peeling layer 15 is composed of a resin having the rubber-like elasticity. Such resins include natural rubbers and synthetic rubbers and resins having rubber-like elasticity that are categorized in Japanese Industrial Standards (JIS) K6397 can be used.

Resins having rubber-like elasticity are categorized in Japanese Industrial Standards (JIS) K6397 into M group including rubber polymers having polymethylene saturated main chains; O group including rubbers containing carbon and oxygen in main chains; Q group including rubbers containing silicon and oxygen in main chains; R group including rubbers containing unsaturated carbon bonds in main chains; T group including rubbers containing carbon, oxygen, and sulfur in main chains; U group including rubbers containing carbon, oxygen, and nitrogen in main chains; and Z group including rubbers containing phosphorus and nitrogen in main chains. Hereinafter, these groups will be described in detail.

M group including rubber polymers having polymethylene saturated main chains includes rubber-like copolymers (ACM) of ethyl acrylate or another acrylate and a small amount of a monomer allowing vulcanization (acrylic rubber); rubber-like copolymers (AEM) of ethyl acrylate or another acrylate and ethylene; rubber-like copolymers (ANM) of ethyl acrylate or another acrylate and acrylonitrile; chlorinated polyethylene (CM); chlorosulfonated polyethylene (CSM); rubber-like copolymers (EBM) of ethylene and butene; rubber-like copolymers (EOM) of ethylene and octene; rubber-like copolymers (EPDM) of ethylene, propylene, and diene; rubber-like copolymers (EPM) of ethylene and propylene; rubber-like copolymers (EVM) of ethylene and vinyl acetate; rubber-like copolymers (FEPM) of tetrafluoroethylene and propylene; rubber-like copolymers (FFKM) in which all the side chains are fluoro groups, perfluoroalkyl groups, or perfluoroalkoxy groups; rubber-like copolymers (FKM) including, as side chains, fluoro groups, perfluoroalkyl groups, or perfluoroalkoxy groups; polyisobutene (IM); rubber-like copolymers (NBM) of acrylonitrile and butadiene in which the main chains are fully hydrogenated (refer to HNBR in R group); rubber-like copolymers (SEBM) of styrene, ethylene, and butene; and rubber-like copolymers (SEPM) of styrene, ethylene, and propylene.

O group including rubbers containing carbon and oxygen in main chains includes polychloromethyloxirane (CO) (epichlorohydrin rubber); rubber-like copolymers (ECO) of ethyleneoxide and epichlorohydrin; rubber-like copolymers (GCO) of epichlorohydrin and allyl glycidyl ether; rubber-like copolymers (GECO) of ethyleneoxide, epichlorohydrin, and allyl glycidyl ether; and rubber-like copolymers (GPO) of propylene oxide and allyl glycidyl ether.

Q group including rubbers containing silicon and oxygen in main chains includes silicone rubbers (FMQ) including methyl substituents and fluoro substituents in the polymer chains; silicone rubbers (FVMQ) including methyl substituents, vinyl substituents, and fluoro substituents in the polymer chains; silicone rubbers (MQ) including methyl substituents in the polymer chains (for example, polydimethylsiloxane); silicone rubbers (PMQ) including methyl substituents and phenyl substituents in the polymer chains; silicone rubbers (PVMQ) including methyl substituents, vinyl substituents, and phenyl substituents in the polymer chains; and silicone rubbers (VMQ) including methyl substituents and vinyl substituents in the polymer chains.

R group including rubbers containing unsaturated carbon bonds in main chains includes acrylate-butadiene rubber (ABR); butadiene rubber (BR); chloroprene rubber (CR); epoxidized natural rubbers (ENR); hydrogenated rubber-like copolymers (HNBR) of acrylonitrile and butadiene (for example, including unsaturated bonds; refer to NBM in M group); rubber-like copolymers (IIR) of isobutene and isoprene (for example, butyl rubber); isoprene rubbers (IR) (for example, synthetic natural rubbers); rubber-like copolymers (MSBR) of α-methylstyrene and butadiene; rubber-like copolymers (NBIR) of acrylonitrile, butadiene, and isoprene; rubber-like copolymers (NBR) of acrylonitrile and butadiene (for example, nitrile rubber); rubber-like copolymers (NIR) of acrylonitrile and isoprene; natural rubbers (NR); norbornene rubbers (NOR); rubber-like copolymers (PBR) of vinylpyridine and butadiene; rubber-like copolymers (PSBR) of vinylpyridine, styrene, and butadiene; rubber-like copolymers (SBR) of styrene and butadiene; rubber-like copolymers (E-SBR) of styrene and butadiene synthesized by emulsion polymerization; rubber-like copolymers (S-SBR) of styrene and butadiene synthesized by solution polymerization; rubber-like copolymers (SIBR) of styrene, isoprene, and butadiene; carboxylated butadiene rubbers (XBR); carboxylated chloroprene rubbers (XCR); carboxylated rubber-like copolymers (XNBR) of acrylonitrile and butadiene; carboxylated rubber-like copolymers (XSBR) of styrene and butadiene; brominated rubber-like copolymers (BIIR) of isobutene and isoprene (for example, brominated butyl rubber); and chlorinated rubber-like copolymers (CIIR) of isobutene and isoprene (for example, chlorinated butyl rubber).

T group including rubbers containing carbon, oxygen, and sulfur in main chains includes: rubbers (OT) including, between polysulfide bonds of polymer chains, —$CH_2$—$CH_2$—O—$CH_2$—O—$CH_2$—$CH_2$— groups or R groups where R represents an aliphatic hydrocarbon but generally not including —$CH_2$—$CH_2$— groups; and rubbers (EOT) including, between polysulfide bonds of polymer chains, —$CH_2$—$CH_2$—O—$CH_2$—O—$CH_2$—$CH_2$— groups and generally —$CH_2$—$CH_2$— groups (in some cases, other aliphatic groups).

U group including rubbers containing carbon, oxygen, and nitrogen in main chains includes rubber-like copolymers (AFMU) of tetrafluoroethylene, trifluoronitrosomethane, and nitroso perfluorobutyric acid; polyester-urethane (AU); and polyether-urethane (EU).

Z group including rubbers containing phosphorus and nitrogen in main chains includes rubbers (FZ) including —P═N— chains and fluoroalkoxy groups bonded to phosphorus atoms in the chains; and rubbers (PZ) including —P═N— chains and aryloxy (phenoxy and substituted phenoxy) bonded to phosphorus atoms in the chains.

The non-transferable peeling layer 15 of another preferred example has a melting point that is 250° C. or more and less than the heating temperature upon thermal transfer. In this case, the non-transferable peeling layer 15 is made to have a melting point within such a range by forming the non-transferable peeling layer 15 with one or more materials selected from heat-resistant resins. Examples of such heat-resistant resins include polyvinyl acetoacetal resins, polyvinyl butyral resins, copolymers of the foregoing, polyvinyl alcohol resins, acrylic resins, polyester resins, polyamide resins, polyamide-imide resins, polyether sulfone resins, polyether ether ketone resins, polysulfone resins, and cellulose derivatives.

Among the above-described resins, in particular, the non-transferable peeling layer 15 is preferably composed of a polyvinyl acetoacetal resin, a polyvinyl acetoacetal-polyvinyl butyral copolymer, or a polymethyl methacrylate resin, each of which has a molecular weight of 100,000 or more.

The non-transferable peeling layer 15 composed of such a heat-resistant resin preferably has thickness t15 that is 20% or more of the thickness t11 of the sheet substrate 11 and the thickness t15 is preferably about 1.0 μm. The upper limit of the thickness t15 of the non-transferable peeling layer 15 is preferably about 56% or less of the thickness t11.

Protective Layer 17

The protective layer 17 is a layer to be thermally transferred onto a surface of printed matter on which an ink image has been formed with thermal energy given by a thermal transfer head. The protective layer 17 having been thermally transferred is positioned as the uppermost layer of the printed matter. The protective layer 17 is mainly composed of a thermoplastic resin. Examples of such a thermoplastic resin include polystyrene resins, acrylic resins, and polyester resins. Use of such a resin as a binder resin for forming the protective layer 17 can impart functions such as abrasion resistance, chemical resistance, and solvent resistance to the resultant protective layer 17. Other than such a main component, the protective layer 17 may further contain a material that can impart weather resistance to the protective layer 17 such as an ultraviolet absorbing agent.

Adhesive Layer 19

The adhesive layer 19 is a layer to be thermally transferred together with the protective layer 17 onto a surface of printed matter with thermal energy given by a thermal transfer head. The adhesive layer 19 having been thermally transferred is positioned between the printed matter and the protective layer 17. The adhesive layer 19 is mainly composed of a thermoplastic resin such as a polyester resin, a cellulosic resin, a polyvinyl chloride acetate copolymer, a urethane resin, or an ethylene-vinyl acetate copolymer. To enhance the adhesion between the adhesive layer 19 and printed matter, the adhesive layer 19 is preferably made to have a relatively low glass transition temperature Tg of about 40° C. to 100° C. The adhesive layer 19 is desirably excellent in terms of various image storage properties such as heat resistance, light resistance, and storability in the dark. Other than such a main component, the adhesive layer 19 may further contain a material such as organic fine particles composed of silicone filler or the like for the purpose of suppressing sticking such as blocking upon contact of the adhesive layer 19 of an ink ribbon with the heat-resistant slip layer of the ink ribbon.

In particular, in the first embodiment, it is important that the refractive index of the adhesive layer 19 is adjusted in the range of more than −0.10 and less than +0.10 with respect to the refractive index of the protective layer 17. That is, the refractive-index difference between the protective layer 17 and the adhesive layer 19 is less than 0.10. As described above, the protective layer 17 and the adhesive layer 19 are composed of different materials to have different desirable properties. However, the refractive-index difference between the protective layer 17 and the adhesive layer 19 may be 0 and a refractive-index difference closer to 0 is more preferred.

Herein, the refractive index of the protective layer 17 and the refractive index of the adhesive layer 19 are refractive indices of the binder resin materials forming these layers. When such a binder resin is a copolymer, the refractive index of such a layer is the refractive index of all the components of the copolymer. When the protective layer 17 and/or the adhesive layer 19 is composed of multi-components, the refractive index of such a layer may be the refractive index of the main component. This term "main component" is a component in the largest amount among the components forming such a layer. When a resin material constituting the main component is a copolymer, the refractive index of such a layer is the refractive index of all the material components constituting the main component.

Heat-Resistant Slip Layer 21

The heat-resistant slip layer 21 is provided for the purpose of suppressing thermal fusion between a thermal transfer head of a thermal transfer printer and the thermal transfer sheet 1 to allow smooth running of the thermal transfer head and removing matter adhering to the thermal transfer head. The heat-resistant slip layer 21 is composed of a heat-resistant resin such as cellulose acetate, a polyvinyl acetoacetal resin, or a polyvinyl butyral resin. The heat-resistant slip layer 21 is desirably maintained to have a substantially constant friction coefficient to a thermal transfer head whether being heated or not. Accordingly, if necessary, the heat-resistant slip layer 21 may further contain an lubricant such as silicone oil, wax, a fatty ester, or a phosphoric ester and organic or inorganic filler. The heat-resistant slip layer 21 may be eliminated when the sheet substrate 11 has good heat resistance and a good slipping property.

Method for Producing Thermal Transfer Sheet

Such a thermal transfer sheet having the above-described configuration can be produced by sequentially forming layers by coating on the sheet substrate 11. In this case, each layer is formed by a step of coating a coating solution containing a resin material and the like for forming the layer by a coating method such as gravure coating, gravure reverse coating, or roll coating and a step of drying the coating solution. These steps are repeated for forming the layers.

The thus-produced thermal transfer sheet 1 is designed to have a refractive-index difference of less than 0.10 between the protective layer 17 and the adhesive layer 19 that are to be transferred onto printed matter on which an ink image has been formed. Thus, reflection of light at the interface between the protective layer 17 and the adhesive layer 19 can be suppressed. Accordingly, scattering of light at the interface between the protective layer 17 and the adhesive layer 19 can be suppressed irrespective of the state of the interface between the protective layer 17 and the adhesive layer 19. As a result, when these layers are transferred onto printed matter, image quality having excellent glossiness can be obtained.

In the case where the non-transferable peeling layer 15 has rubber-like elasticity, when the protective layer 17 and the adhesive layer 19 are transferred onto printed matter, the surface of the protective layer 17 can be maintained as a smooth surface. Accordingly, scattering of light at the surface of the protective layer 17 can also be suppressed and hence the effect of enhancing the glossiness can be achieved.

Specifically, when the protective layer 17 and the adhesive layer 19 of the thermal transfer sheet 1 are transferred onto printed matter, the heat-resistant slip layer 21 side surface of the thermal transfer sheet 1 is scanned with a thermal transfer head having a high temperature of 300° C. or more and the thermal transfer sheet 1 is cooled immediately after the scanning. In such a cooling period, the sheet substrate 11 of the thermal transfer sheet 1 is subjected to thermal deformation (thermal contraction). However, since the non-transferable peeling layer 15 has rubber-like elasticity, the non-transferable peeling layer 15 absorbs the irregularities caused by the deformation of the sheet substrate 11 and suppresses spreading of the irregularities to the protective layer 17.

Since a rubber-like elastic body can be seen as a liquid having a considerably high viscosity, the surface layer of the rubber-like elastic body absorbs small deformation of the sheet substrate 11 (for example, deformation caused by pressure, heat, or the like). The rubber-like elastic body recovers substantially at the instant when an external force applied by the sheet substrate 11 is removed. Since the non-transferable peeling layer 15 is composed of a resin having rubber-like elasticity, even when the non-transferable peeling layer 15 side of the sheet substrate 11 is deformed, the surface layer of the non-transferable peeling layer 15 close to the sheet substrate 11 elastically deforms and absorbs such deformation and hence this deformation does not spread to the protective layer 17 side of the non-transferable peeling layer 15. Accordingly, when the heat-resistant slip layer 21 side of the sheet substrate 11 is brought into contact with and scanned with a thermal transfer head and the sheet substrate 11 is subsequently subjected to thermal deformation (thermal contraction) and has irregularities, the peeled surface of the protective layer 17 is still a smooth surface.

Even when the non-transferable peeling layer 15 has a melting point that is 250° C. or more and less than the heating temperature upon thermal transfer, the surface of the protective layer 17 can be kept smooth after the protective layer 17 and the adhesive layer 19 have been transferred onto printed matter. Accordingly, scattering of light at the surface of the protective layer 17 can also be suppressed and hence the effect of enhancing the glossiness can be achieved.

Specifically, when the protective layer 17 and the adhesive layer 19 of the thermal transfer sheet 1 are transferred onto printed matter, the heat-resistant slip layer 21 side surface of the thermal transfer sheet 1 is scanned with a thermal transfer head having a high temperature of 300° C. or more and the thermal transfer sheet 1 is cooled immediately after the scanning. In such a cooling period, the sheet substrate 11 of the thermal transfer sheet 1 is subjected to thermal deformation (thermal contraction). However, when the non-transferable peeling layer 15 has a melting point less than the heating temperature of the thermal transfer head, a surface layer of the non-transferable peeling layer 15 close to the sheet substrate 11 becomes flowable by the heat of the thermal transfer head and absorbs the irregularities caused by the deformation of the sheet substrate 11. Accordingly, spreading of the irregularities caused by the deformation of the sheet substrate 11 to the protective layer 17 can be suppressed.

When the non-transferable peeling layer 15 has a melting point of 250° C. or more, it has a relatively high heat resistance. Accordingly, the thermal deformation of the sheet substrate 11 after the scanning with a thermal transfer head does not spread to the protective layer 17 side of the non-transferable peeling layer 15 and hence the peeled surface of the protective layer 17 has a small surface roughness.

Additionally, when the non-transferable peeling layer 15 has a thickness that is 20% or more of the thickness of the sheet substrate 11, the deformation of the non-transferable peeling layer 15 does not spread to the protective layer 17 side of the non-transferable peeling layer 15 and hence the peeled surface of the protective layer 17 is still a smooth surface.

2. Second Embodiment

Figure 2:
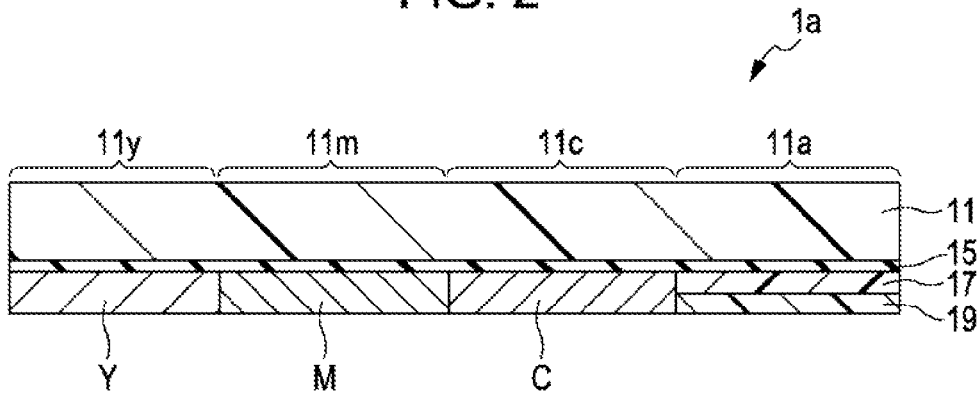
FIG. 2 is a sectional schematic view of a main part of an ink ribbon according to an embodiment of the present invention.

FIG. 2 is a sectional schematic view of a main part illustrating the configuration of an ink ribbon 1*a* according to an embodiment of the present invention. The same elements as in the first embodiment are denoted with identical element numerals in FIG. 2.

The ink ribbon 1*a* according to the second embodiment in FIG. 2 has a configuration in which a protective region 11*a* including the protective layer 17 described in the first embodiment and printing regions 11*c*, 11*m*, and 11*y* respectively including ink layers C, M, and Y are sequentially provided in a planar arrangement in a direction. The configuration of the protective region 11*a* is the same as the configuration of the thermal transfer sheet 1 described in the first embodiment. The cyan printing region 11*c* includes the cyan ink layer C. The magenta printing region 11*m* includes the magenta ink layer M. The yellow printing region 11*y* includes the yellow ink layer Y. Sensor marks (not shown in FIG. 2) are further provided between the regions 11*a*, 11*c*, 11*m*, and 11*y*.

The ink layers C, M, and Y provided in the printing regions 11*c*, 11*m*, and 11*y* have a configuration in which pigments are dispersed or dissolved in binder resins. Examples of such binder resins include cellulosic resins such as methylcellulose, ethylcellulose, ethylhydroxyethylcellulose, hydroxypropylcellulose, cellulose acetate butyrate, and cellulose acetate; vinyl resins such as polyvinyl alcohol, polyvinyl butyral, polyvinyl acetoacetal, polyvinyl acetate, and polystyrene; polyester resins, acrylic resins, and urethane resins.

The pigments used are materials having conditions. For example, materials that readily sublime/thermally diffuse without being thermally decomposed within the thermal energy range of a thermal transfer head; are stable in terms of heat, light, temperature, chemicals and have excellent image storability; have preferable absorption wavelength ranges; and are less likely to reprecipitate in ink layers. Additionally, such materials are preferably easy to synthesize.

Such pigments are often used in combination and preferably have thermal transfer property. Specifically, pigment molecules preferably diffuse heat from the ink layers. Any existing pigment used for a thermal transfer method can be used for embodiments of the present invention and pigments for embodiments of the present invention are not particularly restricted.

Examples of such a cyan pigment include anthraquinone pigments, naphthoquinone pigments, heterocyclic azo pigments, indoaniline pigments, and mixed pigments of the foregoing. Examples of such a magenta pigment include azo pigments, anthraquinone pigments, styryl pigments, heterocyclic azo pigments, and mixed pigments of the foregoing. Examples of such a yellow pigment include azo pigments, disazo pigments, methine pigments, styryl pigments, pyridone-azo pigments, and mixed pigments of the foregoing.

The configuration between the sheet substrate 11 and the ink layers C, M, and Y in the printing regions 11*c*, 11*m*, and 11*y* may be the same as the configuration between the sheet substrate 11 and the protective layer 17 in the protective region 11*a*.

When thermal transfer printing is performed with a thermal transfer printer with the ink ribbon 1*a* described above, the ink layers C, M, and Y in the printing regions 11*c*, 11*m*, and 11*y* are thermally transferred onto a printing sheet with a thermal transfer head of the thermal transfer printer to thereby form an ink image. After that, the protective layer 17 and the adhesive layer 19 are thermally transferred with the thermal transfer head of the thermal transfer printer onto the printing sheet on which the ink image has been formed.

When the ink ribbon 1*a* having the above-described configuration is used, the ink image formed by the transfer of the ink layers C, M, and Y in the printing regions 11*c*, 11*m*, and 11*y* is covered with the protective layer 17 and the adhesive layer 19 transferred from the protective region 11*a*. Since the protective layer 17 and the adhesive layer 19 have the same configuration as in the first embodiment described above, scattering of light at the interface between the protective layer 17 and the adhesive layer 19 can be suppressed irrespective of the state of the interface. Additionally, when the protective layer 17 and the adhesive layer 19 are transferred onto printed matter, the surface of the protective layer 17 can be kept as a smooth surface. As a result, by transferring the protective layer 17 and the adhesive layer 19 onto printed matter on which an ink image has been formed, solvent resistance and durability can be imparted to the printed matter and the printed matter also having excellent glossiness can be obtained.

EXAMPLES

Hereinafter, examples of the present invention and comparative examples and evaluation of these examples will be described.

Examples 1 to 5 and Comparative Examples 1 and 2

The non-transferable peeling layer 15 was formed on the sheet substrate 11. Specifically, a coating solution was prepared by mixing components in the composition shown in Table 1 below. The coating solution was applied to a surface of a sheet substrate (K604E4.5W manufactured by Mitsubishi Polyester Film Corporation) composed of polyester and having a thickness of 4.5 μm such that the resultant layer had a dry thickness of about 1.0 μm. The coated layer was then dried at 90° C. for a minute. Thus, the non-transferable peeling layer 15 was formed.

TABLE 1

| | Name of component | Blending amount (parts by weight) |
|---|---|---|
| Non-transferable peeling layer | KS-847T (silicone resin manufactured by Shin-Etsu Chemical Co., Ltd.) | 100 parts |
| | CAT-PL-50T (curing agent manufactured by Shin-Etsu Chemical Co., Ltd.) | 3 parts |
| | Toluene | 197 parts |

The protective layer 17 was subsequently formed. Specifically, a coating solution containing any one of Compositions 1 to 7 shown in Table 2 below was applied to the non-transferable peeling layer 15 such that the resultant layer had a dry thickness of 0.8 μm. The coated layer was then dried at 90° C. for a minute. Thus, the protective layer 17 was formed.

TABLE 2

| | | Name of component | Refractive index | Blending amount (parts by weight) |
|---|---|---|---|---|
| Protective layer | Composition 1 | Hydroxyethyl methacrylate | 1.43 | 10 parts |
| | | Methyl ethyl ketone | — | 90 parts |
| | Composition 2 | Vinyl acetate | 1.46 | 10 parts |
| | | Methyl ethyl ketone | — | 45 parts |
| | | Toluene | — | 45 parts |
| | Composition 3 | Polymethyl methacrylate | 1.49 | 10 parts |
| | | Methyl ethyl ketone | — | 90 parts |
| | Composition 4 | Polyphenoxyethyl methacrylate | 1.51 | 10 parts |
| | | Methyl ethyl ketone | — | 90 parts |
| | Composition 5 | Polyphenyl methacrylate | 1.57 | 10 parts |
| | | Methyl ethyl ketone | — | 45 parts |
| | | Toluene | — | 45 parts |
| | Composition 6 | Polystyrene | 1.59 | 10 parts |
| | | Toluene | — | 90 parts |
| | Composition 7 | Polyurethane | 1.60 | 10 parts |
| | | Methyl ethyl ketone | — | 45 parts |
| | | Toluene | — | 45 parts |

The adhesive layer 19 was subsequently formed. Specifically, a coating solution containing any one of Compositions a and b shown in Table 3 below was applied to the protective layer 17 such that the resultant layer had a dry thickness of about 0.8 μm. The coated layer was then dried at 100° C. for a minute. Thus, the adhesive layer 19 was formed.

TABLE 3

| | | Name of component | Refractive index | Blending amount (parts by weight) |
|---|---|---|---|---|
| Adhesive layer | Composition a | Polyethyl methacrylate | 1.49 | 10 parts |
| | | Methyl ethyl ketone | — | 45 parts |
| | | Toluene | — | 45 parts |
| | Composition b | Polyethyl methacrylate/polyphenoxyethyl methacrylate copolymer | 1.49/1.51 | 10 parts |
| | | Methyl ethyl ketone | — | 45 parts |
| | | Toluene | — | 45 parts |

In this way, the thermal transfer sheets 1 of Examples 1-a to 5-b and Comparative examples of 1-a to 2-b in Table 4 below in which the non-transferable peeling layer 15, the protective layer 17, and the adhesive layer 19 were sequentially stacked in this order on the sheet substrate 11 were produced.

TABLE 4

| | Protective layer | Adhesive layer | Refractive-index difference | Glossiness evaluation |
|---|---|---|---|---|
| Example 1-a | Composition 1 | Composition a | 0.06 | Good |
| Example 1-b | | Composition b | 0.06/0.08 | Good |
| Example 2-a | Composition 2 | Composition a | 0.03 | Good |
| Example 2-b | | Composition b | 0.03/0.05 | Good |
| Example 3-a | Composition 3 | Composition a | 0.00 | Excellent |
| Example 3-b | | Composition b | 0.00/0.02 | Excellent |
| Example 4-a | Composition 4 | Composition a | 0.02 | Good |
| Example 4-b | | Composition b | 0.02/0.00 | Good |
| Example 5-a | Composition 5 | Composition a | 0.08 | Good |
| Example 5-b | | Composition b | 0.08/0.06 | Good |
| Comparative example 1-a | Composition 6 | Composition a | 0.10 | Poor |
| Comparative example 1-b | | Composition b | 0.10/0.08 | Poor |
| Comparative example 2-a | Composition 7 | Composition a | 0.11 | Poor |
| Comparative example 2-b | | Composition b | 0.11/0.09 | Poor |

White solid images were printed on genuine printing paper sheets for UP-DR150 manufactured by Sony Corporation with the thermal transfer sheets obtained in Examples 1-a to 5-b and Comparative examples 1-a to 2-b with a UP-DR150 printer manufactured by Sony Corporation. The resultant printed products were visually inspected for evaluation of glossiness and measured in terms of a 45° image clarity profile.

The results of the glossiness evaluation are also shown in Table 4 above. In the visual inspection of the glossiness evaluation, a reflection of a fluorescent lamp was formed on a white-solid printed matter and the sharpness of the reflection was visually evaluated. The results show that sharp images having good glossiness were obtained in the printed products on which the thermal transfer sheets of Examples 1-a to 5-b in which the refractive-index difference between the protective layer and the adhesive layer was less than 0.10 according to embodiments of the present invention were transferred. In contrast, good glossiness was not obtained in the printed products on which the thermal transfer sheets of Comparative examples 1-a to 2-b in which the refractive-index difference between main components of the protective layer and the adhesive layer was 0.10 or more were transferred.

Figure 3:
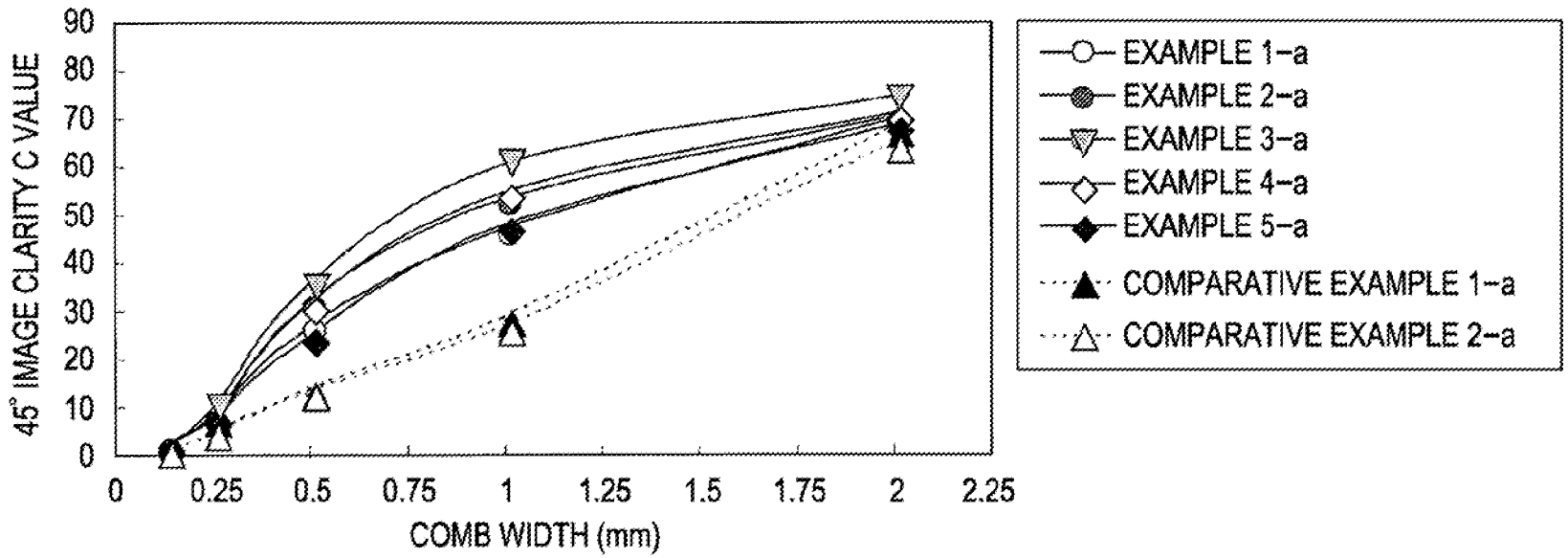
FIG. 3 illustrates 45° image clarity profiles measured in terms of Examples 1-a to 5-a and Comparative examples of 1-a and 2-a.

FIG. 3 illustrates 45° image clarity profiles measured in terms of Examples 1-a to 5-a and Comparative examples 1-a and 2-a. FIG. 3 shows that image clarity C values considerably increase in the printed products on which the thermal transfer sheets of Examples 1-a to 5-a in which the refractive-index difference between the protective layer and the adhesive layer was less than 0.10 according to embodiments of the present invention were transferred, compared with Comparative examples 1-a and 2-a. Therefore, it has been confirmed that the effect of suppressing scattering of light and enhancing the glossiness in printed products on which thermal transfer sheets have been transferred is achieved in embodiments of the present invention.

Examples 6 to 10 and Comparative examples 3 and 4

First, the sheet substrate 11 will be described. A polyester film substrate (K604E4.5W manufactured by Mitsubishi Polyester Film Corporation) having a thickness of 4.5 μm was selected as an example and used as the sheet substrate 11. The non-transferable peeling layers 15 were formed on the sheet substrates 11. Specifically, coating solutions of Examples 6 to 10 shown in Table 5 below were applied to surfaces of the sheet substrates 11 such that the resultant layers had a dry thickness of 1.0 μm. The coated layers were then dried by baking at 100° C. for 2 minutes. Thus, the non-transferable peeling layers 15 of the thermal transfer sheets 1 were formed.

TABLE 5

| | Name of component | Blending amount (parts by weight) |
|---|---|---|
| Example 6 | Silicone resin (KS-847T manufactured by Shin-Etsu Chemical Co., Ltd.) | 100 parts |
| | Curing agent (CAT-PL-50T manufactured by Shin-Etsu Chemical Co., Ltd.) | 3 parts |
| | Toluene | 197 parts |
| Example 7 | Silicone resin (KS-774 manufactured by Shin-Etsu Chemical Co., Ltd.) | 100 parts |
| | Curing agent (CAT-PL-50T manufactured by Shin-Etsu Chemical Co., Ltd.) | 3 parts |
| | Toluene | 197 parts |
| Example 8 | Silicone resin (KS-3703 manufactured by Shin-Etsu Chemical Co., Ltd.) | 100 parts |
| | Curing agent (CAT-PL-50T manufactured by Shin-Etsu Chemical Co., Ltd.) | 3 parts |
| | Toluene | 197 parts |
| Example 9 | Ethylene Propylene rubber (EP24 manufactured by JSR) | 7.5 parts |
| | Toluene | 92.5 parts |
| Example 10 | Styrene-butadiene rubber (H-1051 manufactured by Asahi Kasei Corporation) | 10 parts |
| | Toluene | 90 parts |

The protective layers 17 having the composition shown in Table 6 below were subsequently formed by coating on the non-transferable peeling layers 15 of Examples 6 to 10 such that the resultant layers had a dry thickness of 0.8 μm and drying (baking at 120° C. for a minute).

The adhesive layers 19 having the composition shown in Table 6 below were subsequently formed by coating on the protective layers 17 such that the resultant layers had a dry thickness of 0.8 μm and drying (baking at 100° C. for a minute).

In this way, the thermal transfer sheets 1 of Examples 6 to 10 in which the non-transferable peeling layer 15, the protective layer 17, and the adhesive layer 19 were stacked on a surface of the sheet substrate 11 were produced.

Hereinafter, thermal transfer laminate films (thermal transfer sheets) of comparative examples will be described.

First, a thermal transfer laminate film of Comparative example 3 will be described.

A polyester film substrate (K604E4.5W manufactured by Mitsubishi Polyester Film Corporation) having a thickness of 4.5 μm was selected as an example and used as a sheet substrate.

A protective layer having the composition shown in Table 6 below was subsequently formed on a surface of the sheet substrate and an adhesive layer having the composition shown in Table 6 was further formed on the protective layer. Thus, the thermal transfer laminate film of Comparative example 3 was formed. A heat-resistant slip layer was also formed on a surface of the sheet substrate, the surface being opposite the protective layer.

TABLE 6

| | Name of component | Blending amount (parts by weight) |
|---|---|---|
| Protective layer | MMA/n-BMA copolymer (LP62/03) | 10 parts |
| | Methyl ethyl ketone | 90 parts |
| Adhesive layer | Styrene/acrylic copolymer (Polysol AT2011) | 10 parts |
| | Methyl ethyl ketone | 45 parts |
| | Toluene | 45 parts |

Second, a thermal transfer laminate film of Comparative example 4 will be described.

A polyester film substrate (K604E4.5W manufactured by Mitsubishi Polyester Film Corporation) having a thickness of 4.5 μm was selected as an example and used as the sheet substrate 11.

A non-transferable peeling layer having the composition of Comparative example 4 shown in Table 7 below was formed by coating on a first surface of the sheet substrate 11 such that the resultant layer had a dry thickness of 1 μm and drying (baking at 100° C. for 2 minutes). Thus, the non-transferable peeling layer of the thermal transfer sheet was formed.

A protective layer having the composition shown in Table 6 above was subsequently formed by coating on the non-transferable peeling layer such that the resultant layer had a dry thickness of 0.8 μm and drying (baking at 120° C. for a minute).

An adhesive layer having the composition shown in Table 6 above was subsequently formed by coating on the protective layer such that the resultant layer had a dry thickness of 0.8 μm and drying (baking at 100° C. for a minute). Thus, the thermal transfer sheet of Comparative example 4 in which the non-transferable peeling layer, the protective layer, and the adhesive layer were stacked on the sheet substrate was formed.

TABLE 7

| | Name of component | Blending amount (parts by weight) |
|---|---|---|
| Comparative example 4 | Polystyrene resin (G32 manufactured by TOYO STYRENE Co., Ltd.) | 10 parts |
| | Toluene | 90 parts |

The protective layers of the thermal transfer sheets of Examples 6 to 10 and Comparative examples 3 and 4 were thermally transferred.

As a result, the thermal transfer sheets of Examples 6 to 10 including the non-transferable peeling layers composed of resins having rubber-like elasticity suppressed spreading of the influence of deformation of the sheet substrates caused by thermal energy given by a thermal transfer head to the protective layers. Thus, it was confirmed that the surfaces of the protective layers having been thermally transferred from the thermal transfer sheets of Examples 6 to 10 had good 20° glossiness and good three-dimensional surface roughness profiles, compared with Comparative examples.

The "20° glossiness" is glossiness determined by glossiness measurement defined in 20° specular glossiness in "Specular glossiness-Methods of measurement" of Japanese Industrial Standards Z8741.

Specifically, white solid images were printed on genuine printing paper sheets for UP-DR150 manufactured by Sony Corporation with thermal transfer sheets obtained in Examples 6 to 10 and Comparative examples 3 and 4 with a UP-DR150 printer manufactured by Sony Corporation. The resultant printed products were analyzed in terms of 20° glossiness and three-dimensional surface roughness profiles and the advantageous effects of the non-transferable peeling layers composed of resins having rubber-like elasticity in Examples were evaluated.

The evaluation results in terms of 20° glossiness are shown in Table 8 below.

TABLE 8

| | 20° glossiness | Glossiness evaluation |
|---|---|---|
| Example 6 | 74 | Excellent |
| Example 7 | 72 | Good |
| Example 8 | 75 | Excellent |
| Example 9 | 69 | Good |
| Example 10 | 70 | Good |
| Comparative example 3 | 53 | Poor |
| Comparative example 4 | 52 | Poor |

Table 8 above shows that Examples 6 to 10 according to embodiments of the present invention had better 20° glossiness by about 30% or more and considerably better glossiness evaluation results than Comparative examples 3 and 4. In the case where the non-transferable peeling layers 15 composed of the silicone resins, the ethylene propylene rubber, and the styrene-butadiene rubber were used, the protective layers 17 having been transferred had good 20° glossiness. In particular, in the case where the non-transferable peeling layers 15 composed of the silicone resins were used, the protective layers 17 having been transferred had good 20° glossiness.

Figure 4A:
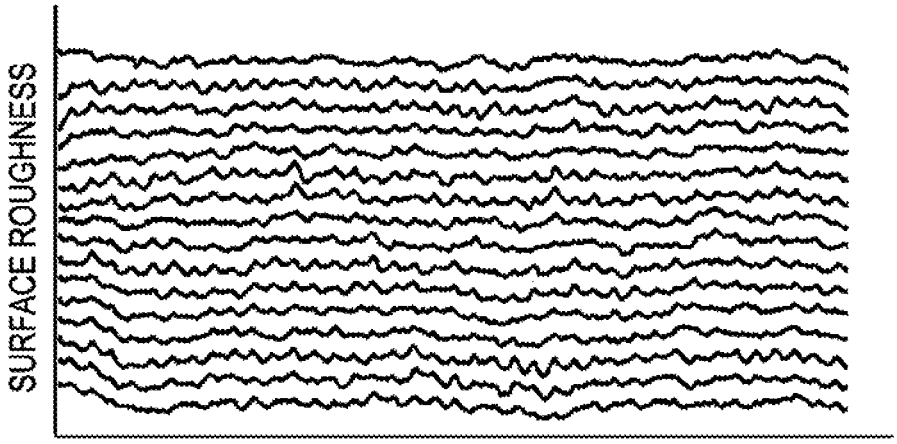
FIGS. 4A and 4B respectively illustrate the measurement results of Example 6 and Comparative example 4 in terms of three-dimensional surface roughness.
Figure 4B:
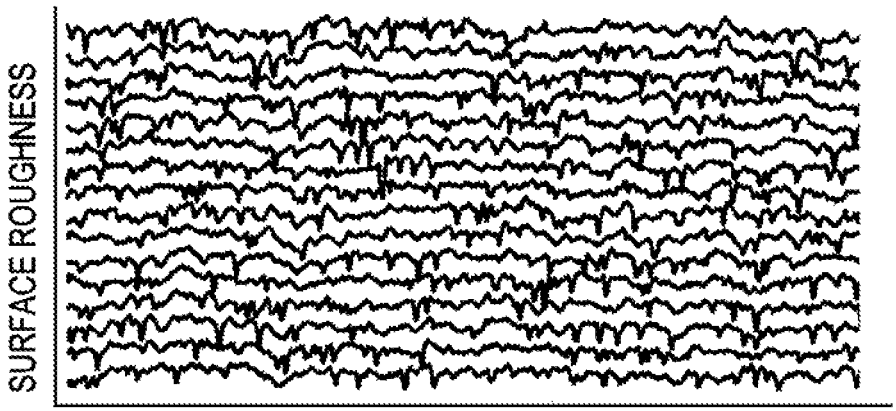

For reference, FIGS. 4A and 4B illustrate the measurement results of Example 6 and Comparative example 4 in terms of three-dimensional surface roughness.

FIG. 4A is an example of data illustrating a surface roughness profile of the protective layer formed with the thermal transfer sheet including the non-transferable peeling layer of Example 6. FIG. 4B is an example of data illustrating a surface roughness profile of the protective layer formed with the thermal transfer sheet including the non-transferable peeling layer of Comparative example 4. The same scales were used for both FIGS. 4A and 4B. The ordinate axis indicates surface roughness measured at regular intervals and the abscissa axis indicates the measurement length of surface roughness.

In FIGS. 4A and 4B, comparison of the surfaces of the printed products obtained in Example 6 and Comparative example 4 in terms of smoothness shows that the surface in Example 6 is more smooth. This result also shows that the non-transferable peeling layer provided between the sheet substrate and the protective layer and having rubber-like elasticity suppressed the influence of deformation of the sheet substrate and the interface between the non-transferable peeling layer and the protective layer was maintained to have a smooth profile.

Examples 11 to 15 and Comparative examples 11 to 16

Hereinafter, examples of thermal transfer laminate films (thermal transfer sheets) according to embodiments of the present invention will be described.

First, the sheet substrates 11 will be described. Polyester film substrates (K604E4.5W manufactured by Mitsubishi Polyester Film Corporation) having a thickness of 4.5 μm were selected as an example and used as the sheet substrates 11.

The non-transferable peeling layers 15 corresponding to Compositions 1 to 5 shown in Table 9 below were formed by coating on first surfaces S1 of the sheet substrates 11 such that the resultant layers had dry thicknesses of 0.5 μm, 0.9 μm, 1.3 μm, and 2.5 μm and drying (baking at 100° C. for 2 minutes). Thus, the non-transferable peeling layers 15 for the thermal transfer sheets 1 were formed.

Thermal transfer sheets including the non-transferable peeling layers 15 composed of Composition 1 and having thicknesses of 0.9 μm, 1.3 μm, and 2.5 μm are respectively defined as Examples 11-1, 11-2, and 11-3.

Thermal transfer sheets including the non-transferable peeling layers 15 composed of Composition 2 and having thicknesses of 0.9 μm, 1.3 μm, and 2.5 μm are respectively defined as Examples 12-1, 12-2, and 12-3.

Thermal transfer sheets including the non-transferable peeling layers 15 composed of Composition 3 and having thicknesses of 0.9 μm, 1.3 μm, and 2.5 μm are respectively defined as Examples 13-1, 13-2, and 13-3.

Thermal transfer sheets including the non-transferable peeling layers 15 composed of Composition 4 and having thicknesses of 0.9 μm, 1.3 μm, and 2.5 μm are respectively defined as Examples 14-1, 14-2, and 14-3.

A thermal transfer sheet including the non-transferable peeling layer 15 composed of Composition 5 and having a thickness of 2.5 μm is defined as Example 15.

Thermal transfer sheets including the non-transferable peeling layers 15 composed of Compositions 1 to 4 and having a thickness of 0.5 μm are respectively defined as Comparative examples 11 to 14.

Thermal transfer sheets including the non-transferable peeling layers 15 composed of Composition 5 and having thicknesses of 0.5 μm, 0.9 μm, and 1.3 μm are respectively defined as Comparative examples 15-1, 15-2, and 15-3.

TABLE 9

| | Name of component | Example 11-1 (thickness: 0.9 μm) | Example 11-2 (thickness: 1.3 μm) | Example 11-3 (thickness: 2.5 μm) | Melting point (° C.) |
|---|---|---|---|---|---|
| | | Blending amount (parts by weight) | | | |
| Composition 1 | Polyvinyl acetoacetal resin (KS3Z manufactured by SEKISUI CHEMICAL CO., LTD.) | 6 | 7 | 8 | 290 |
| | Methyl ethyl ketone | 47 | 46.5 | 46 | — |
| | Toluene | 47 | 46.5 | 46 | — |
| | Name of component | Example 12-1 (thickness: 0.9 μm) | Example 12-2 (thickness: 1.3 μm) | Example 12-3 (thickness: 2.5 μm) | Melting point (° C.) |
| | | Blending amount (parts by weight) | | | |
| Composition 2 | Polyvinyl acetoacetal-polyvinyl butyral copolymer (6000CS manufactured by DENKI KAGAKU KOGYO KABUSHIKI KAISHA) | 5 | 6 | 8 | 320 |
| | Methyl ethyl ketone | 47.5 | 47 | 46 | — |
| | Toluene | 47.5 | 47 | 46 | — |
| | Name of component | Example 13-1 (thickness: 0.9 μm) | Example 13-2 (thickness: 1.3 μm) | Example 13-3 (thickness: 2.5 μm) | Melting point (° C.) |
| | | Blending amount (parts by weight) | | | |
| Composition 3 | Polymethyl methacrylate resin (MM-50 manufactured by Fujikura Kasei Co., Ltd.) | 7 | 9 | 12 | 250 |
| | Methyl ethyl ketone | 93 | 91 | 88 | — |
| | Name of component | Example 14-1 (thickness: 0.9 μm) | Example 14-2 (thickness: 1.3 μm) | Example 14-3 (thickness: 2.5 μm) | Melting point (° C.) |
| | | Blending amount (parts by weight) | | | |
| Composition 4 | Polymethyl methacrylate resin (MM-100 manufactured by Fujikura Kasei Co., Ltd.) | 7 | 8 | 10 | 270 |
| | Methyl ethyl ketone | 93 | 92 | 90 | — |
| | Name of component | Comparative example 15-2 (thickness: 0.9 μm) | Comparative example 15-3 (thickness: 1.3 μm) | Example 15 (thickness: 2.5 μm) | Melting point (° C.) |
| | | Blending amount (parts by weight) | | | |
| Composition 5 | Polyvinyl acetoacetal resin (KS1 manufactured by SEKISUI CHEMICAL CO., LTD.) | 8 | 10 | 15 | 200 |
| | Methyl ethyl ketone | 46 | 45 | 42.5 | — |
| | Toluene | 46 | 45 | 42.5 | — |

The melting points of heat-resistant resins used for the non-transferable peeling layers 15 were determined with a "Koka-type" flow tester for generally measuring the melting points of resins. Specifically, the melting points shown in Table 9 above were determined with CFT-500A manufactured by SHIMADZU CORPORATION under flow conditions of a pressure of 100 kg/cm$^2$, a rate of 6° C./min, and a nozzle size of 1 mm (diameter)×10 mm.

Protective layers 17 having the composition shown in Table 10 below were subsequently formed by coating on the non-transferable peeling layers 15 composed of Compositions 1 to 5 such that the resultant layers had a dry thickness of 0.8 μm and drying (baking at 120° C. for a minute).

Adhesive layers 19 having the composition shown in Table 10 below were subsequently formed by coating on the protective layers 17 such that the resultant layers had a dry thickness of 0.8 μm and drying (baking at 100° C. for a minute). Thus, the thermal transfer sheets 1 in which the non-transferable peeling layers 15 composed of Compositions 1 to 5, the protective layers 17, and the adhesive layers 19 were stacked on the first surfaces of the sheet substrates 11 were formed.

TABLE 10

| | Name of component | Blending amount (parts by weight) |
|---|---|---|
| Protective layer | MMA/n-BMA copolymer (LP62/03) | 10 parts |
| | Methyl ethyl ketone | 90 parts |
| Adhesive layer | Styrene/acrylic copolymer (Polysol AT2011) | 10 parts |
| | Methyl ethyl ketone | 45 parts |
| | Toluene | 45 parts |

Hereinafter, Comparative example 16 will be described.

A polyester film substrate (K200-6E manufactured by Mitsubishi Polyester Film Corporation) having a thickness of 6.0 μm was selected as an example and used as the sheet substrate 11.

The protective layer 17 having the composition shown in Table 10 above was formed by coating on a first surface of the sheet substrate 11 such that the resultant layer had a dry thickness of 0.8 μm and drying (baking at 120° C. for a minute). The adhesive layer 19 having the composition shown in Table 10 above was subsequently formed by coating on the protective layer 17 such that the resultant layer had a dry thickness of 0.8 μm and drying (baking at 100° C. for a minute). Thus, the thermal transfer sheet of Comparative example 16 in which the protective layer 17 and the adhesive layer 19 were stacked on the first surface of the sheet substrate 11 was formed.

The heat-resistant slip layers 21 were formed on the back surfaces (second surfaces opposite the first surfaces) of the sheet substrates 11 in Examples and Comparative examples above.

The protective layers 17 of the thermal transfer sheets obtained in Examples 11 to 15 and Comparative examples 11 to 16 were thermally transferred.

As a result, when the thermal transfer sheets 1 including the non-transferable peeling layers 15 that were composed of Compositions 1 to 4 containing heat-resistant resins having melting points of 250° C. or more shown in Table 9 and had thicknesses of 20% or more of the thickness of the sheet substrates 11 were used, spreading of the influence of the deformation of the sheet substrates 11 caused by thermal energy given by a thermal transfer head to the protective layers 17 was suppressed. Thus, it was confirmed that the surfaces of the protective layers 17 having been thermally transferred from the thermal transfer sheets 1 of Examples 11 to 15 had good 20° glossiness and good three-dimensional surface roughness profiles, compared with Comparative examples.

The "20° glossiness" is glossiness determined by glossiness measurement defined in 20° specular glossiness in "Specular glossiness-Methods of measurement" of Japanese Industrial Standards Z8741.

Specifically, white solid images were printed on genuine printing paper sheets for UP-DR150 manufactured by Sony Corporation with thermal transfer sheets obtained in Examples 11 to 15 and Comparative examples 11 to 16 with a UP-DR150 printer manufactured by Sony Corporation at a heating temperature of 300° C. or more given by a thermal transfer head. The resultant printed products were analyzed in terms of 20° glossiness and three-dimensional surface roughness profiles and the advantageous effects of the non-transferable peeling layers 15 in Examples were evaluated.

The evaluation results in terms of 20° glossiness are shown in Table 11 below.

TABLE 11

| | | Thickness (μm) | Layer-substrate thickness ratio | 20° glossiness | Glossiness evaluation |
|---|---|---|---|---|---|
| Composition 1 | Comparative example 11 | 0.5 | 11 | 84 | Poor |
| | Example 11-1 | 0.9 | 20 | 90 | Good |
| | Example 11-2 | 1.3 | 29 | 92 | Good |
| | Example 11-3 | 2.5 | 56 | 99 | Excellent |
| Composition 2 | Comparative example 12 | 0.5 | 11 | 84 | Poor |
| | Example 12-1 | 0.9 | 20 | 91 | Good |
| | Example 12-2 | 1.3 | 29 | 96 | Excellent |
| | Example 12-3 | 2.5 | 56 | 99 | Excellent |
| Composition 3 | Comparative example 13 | 0.5 | 11 | 83 | Poor |
| | Example 13-1 | 0.9 | 20 | 91 | Good |
| | Example 13-2 | 1.3 | 29 | 94 | Good |
| | Example 13-3 | 2.5 | 56 | 97 | Excellent |
| Composition 4 | Comparative example 14 | 0.5 | 11 | 78 | Poor |
| | Example 14-1 | 0.9 | 20 | 91 | Good |
| | Example 14-2 | 1.3 | 29 | 95 | Excellent |
| | Example 14-3 | 2.5 | 56 | 98 | Excellent |
| Composition 5 | Comparative example 15-1 | 0.5 | 11 | 80 | Poor |
| | Comparative example 15-2 | 0.9 | 20 | 86 | Poor |
| | Comparative example 15-3 | 1.3 | 29 | 87 | Poor |
| | Example 15 | 2.5 | 56 | 94 | Good |
| — | Comparative example 16 | — | — | 80 | Poor |

In Table 11 above, "Layer-substrate thickness ratio" is a value defined by the following formula.

Layer-substrate thickness ratio (%)=100×(Thickness of Composition/Thickness (4.5 μm) of sheet substrate)

In this formula, "Composition" means one of Compositions 1 to 5 forming the non-transferable peeling layers 15.

The results show that, when the non-transferable peeling layers 15 are composed of Compositions 1 to 4, which have melting points of 250° C. or more and less than the heating temperature (300° C. or more) upon thermal transfer and have layer-substrate thickness ratios of 20% or more, the 20° glossiness is increased by about 10% to 20% and the glossiness evaluation results are considerably good compared with Comparative examples. When Composition 5, which has a melting point of 200° C., was used, a good glossiness evaluation result was obtained only in the case where the non-transferable peeling layer 15 had a large thickness of 2.5 μm.

The results also show that, when the non-transferable peeling layers 15 have a thickness of 0.9 μm or more and 2.5 μm or less, the 20° glossiness is increased by about 10% to 20% and the glossiness evaluation results are considerably good compared with Comparative examples.

Figure 5A:
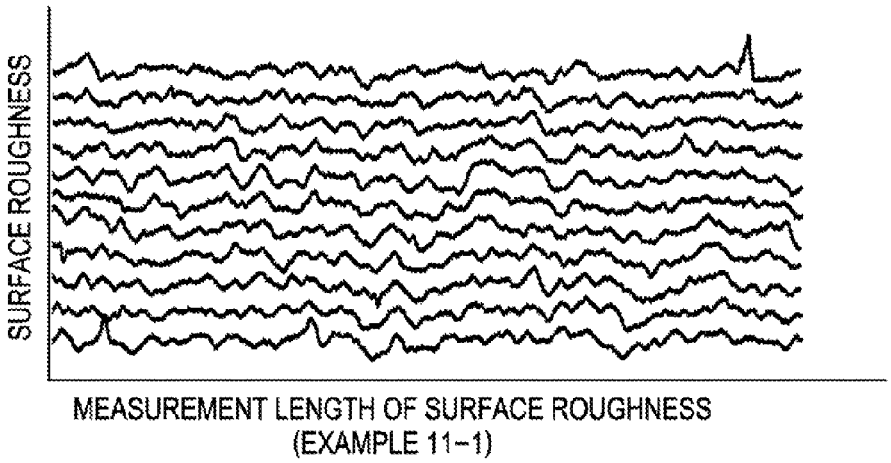
FIGS. 5A and 5B respectively illustrate the measurement results of Example 11-1 and Comparative example 11 in terms of three-dimensional surface roughness.
Figure 5B:
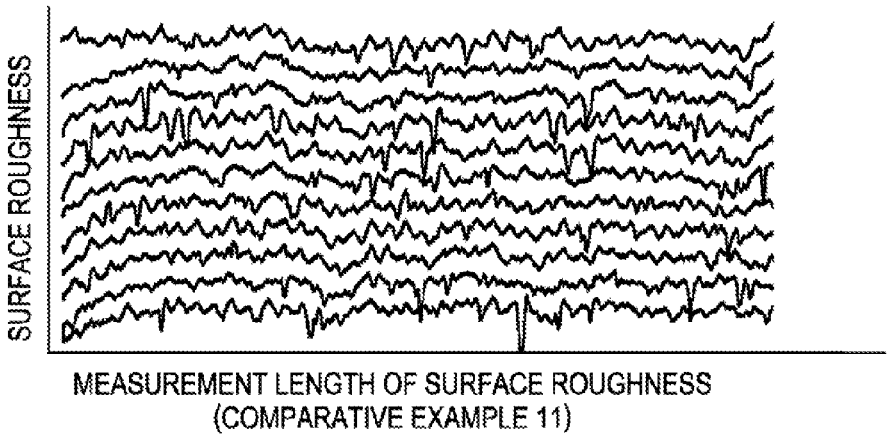

For reference, FIGS. 5A and 5B illustrate the measurement results of Example 11-1 and Comparative example 11 in terms of three-dimensional surface roughness.

FIG. 5A is an example of data illustrating a surface roughness profile of the protective layer 17 formed with the thermal transfer sheet 1 including the non-transferable peeling layer of Example 11-1. FIG. 5B is an example of data illustrating a surface roughness profile of the protective layer 17 formed with the thermal transfer sheet 1 including the non-transferable peeling layer of Comparative example 11. The same scales were used for both FIGS. 5A and 5B. The ordinate axis indicates surface roughness measured at regular intervals and the abscissa axis indicates the measurement length of surface roughness.

In FIGS. 5A and 5B, comparison of the surfaces of the printed products obtained in Example 11-1 and Comparative example 11 in terms of smoothness shows that the surface in Example 11-1 is more smooth. This result also shows that the non-transferable peeling layer provided between the sheet substrate and the protective layer suppressed the influence of deformation of the sheet substrate and the interface between the non-transferable peeling layer and the protective layer was maintained to have a smooth profile.

The present application contains subject matter related to that disclosed in Japanese Priority Patent Application JP 2009-129785 filed in the Japan Patent Office on May 29, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal transfer sheet comprising:
a sheet substrate;
a protective layer provided on the sheet substrate; and
an adhesive layer provided on the protective layer,
wherein,
the protective layer is mainly composed of one first thermoplastic resin,
the adhesive layer is mainly composed of one second thermoplastic resin,
the first and second thermoplastic resins have different compositions, and
the first thermoplastic resin in the protective layer and the second thermoplastic resin in the adhesive layer are such that a refractive-index difference between the protective layer and the adhesive layer is less than 0.10.

2. The thermal transfer sheet of claim 1, wherein the refractive-index difference between the protective layer and the adhesive layer is a difference between a refractive index of the main composition of the protective layer and a refractive index of the main composition of the adhesive layer.

3. The thermal transfer sheet of claim 1 or 2, wherein the protective layer is provided on the sheet substrate with a non-transferable peeling layer therebetween; and
the non-transferable peeling layer has rubber-like elasticity.

4. The thermal transfer sheet of claim 1 or 2, wherein:
the protective layer is provided on the sheet substrate with a non-transferable peeling layer therebetween; and
the non-transferable peeling layer has a melting point that is 250° C. or more and less than a heating temperature upon thermal transfer.

5. The thermal transfer sheet of claim 4, wherein the non-transferable peeling layer has a thickness that is 20% or more of a thickness of the sheet substrate.

6. An ink ribbon comprising:
a sheet substrate;
a protective region including a protective layer and an adhesive layer sequentially stacked on the sheet substrate in this order; and
a printing region including an ink layer;
wherein
the protective region and the printing region are provided in a planar arrangement, and
a refractive-index difference between the protective layer and the adhesive layer is less than 0.10.

7. The thermal transfer sheet of claim 1, wherein:
the protective layer is on one side of the substrate, and
the thermal transfer sheet further comprises a heat-resistant slip layer on another side of the sheet substrate, the heat-resistant slip layer suppressing thermal fusion between a thermal transfer head and the thermal transfer sheet.

8. The thermal transfer sheet of claim 7, wherein the heat-resistant slip layer has a substantially constant friction coefficient to the thermal transfer head whether heated or not.

9. The thermal transfer sheet of claim 1, further comprising a primer layer on the sheet substrate and a non-transferable peeling layer on the primer layer, wherein the protective layer is on the non-transferable peeling layer.

* * * * *